United States Patent [19]

Rowley et al.

[11] 3,962,675

[45] June 8, 1976

[54] UNDERWATER FLOODLIGHT ASSEMBLY

[75] Inventors: William N. Rowley, Palos Verdes Estates; Gordon F. Ehret, Alhambra, both of Calif.

[73] Assignee: Weil-McLain Co., Inc., Dallas, Tex.

[22] Filed: Mar. 25, 1975

[21] Appl. No.: 561,989

[52] U.S. Cl. ..... 240/26; 240/2 LC

[51] Int. Cl.[2] ..... F21V 31/00

[58] Field of Search ..... 240/2 LC, 26, 41.5, 240/41.55

[56] References Cited

UNITED STATES PATENTS

| | | | |
|---|---|---|---|
| 2,906,863 | 9/1959 | Ritter | 240/26 |
| 2,935,601 | 5/1960 | Steiner et al. | 240/26 |
| 2,992,321 | 7/1961 | Robbins | 240/41.55 |
| 3,192,379 | 6/1965 | Garmo | 240/26 |
| 3,265,884 | 8/1966 | Kelley | 240/26 |

*Primary Examiner*—R. L. Moses
*Attorney, Agent, or Firm*—Lane, Aitken, Dunner & Ziems

[57] ABSTRACT

An underwater floodlight assembly in which an open-ended shell extends in an opening formed in the wall of a reservoir for water, with the shell having an outwardly extending integrally formed flange which engages the surface of the wall. A plurality of integrally formed bosses extend from the flange and into the wall. An open-ended inner housing is disposed within the shell and includes a receptacle for a lightbulb, and a mounting assembly mounts a cover over the open end portion of the housing and the shell. An insert of an electrical conductive material is molded integral with the flange and is connected to ground, and the mounting assembly establishes an electrical current flow path from the housing to the insert.

10 Claims, 4 Drawing Figures

UNDERWATER FLOODLIGHT ASSEMBLY

Background of the Invention

This invention relates to an underwater floodlight assembly and, more particularly, to such an assembly for use in water reservoirs, such as swimming pools, or the like.

The mounting of underwater floodlight assemblies in areas where intimate contact with water is customarily expected, presents several problems. For example, it is important to insure that the light bulbs can be replaced with a minimum of difficulty without having to drain the reservoir of water. Also, since water is a good conductor of electricity, a superior electrical grounding system must be established by the assembly.

In order to accomplish these goals, previous designs of underwater floodlight assemblies have usually been formed of a metal shell which houses the bulb assembly and which receives a cover. Since the shell must include ancillary components, such as mounting flanges, internally threaded bosses for connecting to electrical conductors, etc., these components must be separately manufactured and attached to the shell. This, of course, considerably adds to the cost of the assembly, both from a materials and labor standpoint.

Summary of the Invention

It is therefore an object of the present invention to provide an underwater floodlight assembly in which the cover for the assembly is readily detachable to enable the light bulb to be quickly and easily changed.

It is a still further object of the present invention to provide an assembly of the above type which has a superior electrical grounding system.

It is a further object of the present invention to provide an assembly of the above type which includes a shell manufactured of a synthetic material with the above-mentioned ancillary components being formed integral therewith.

Toward the fulfillment of these and other objects, the assembly of the present invention comprises an open-ended shell adapted to extend in an opening formed in a wall of a reservoir for water, the shell having an outwardly extending integrally formed flange which engages the surface of the wall, a plurality of bosses formed integrally with the flange and extending in a spaced relationship around the shell, an open-ended inner housing disposed within the shell and including light bulb receptacle means, and cover means for covering the open ends of the housing and the shell. An insert of an electrical conductive material is molded integral with the flange and connected to ground, and an electrical current flow path is established from the housing to the insert. An internally threaded hub is also formed integral with the shell for receiving an electrical conductor.

Description of the Preferred Embodiments

Figure 1:
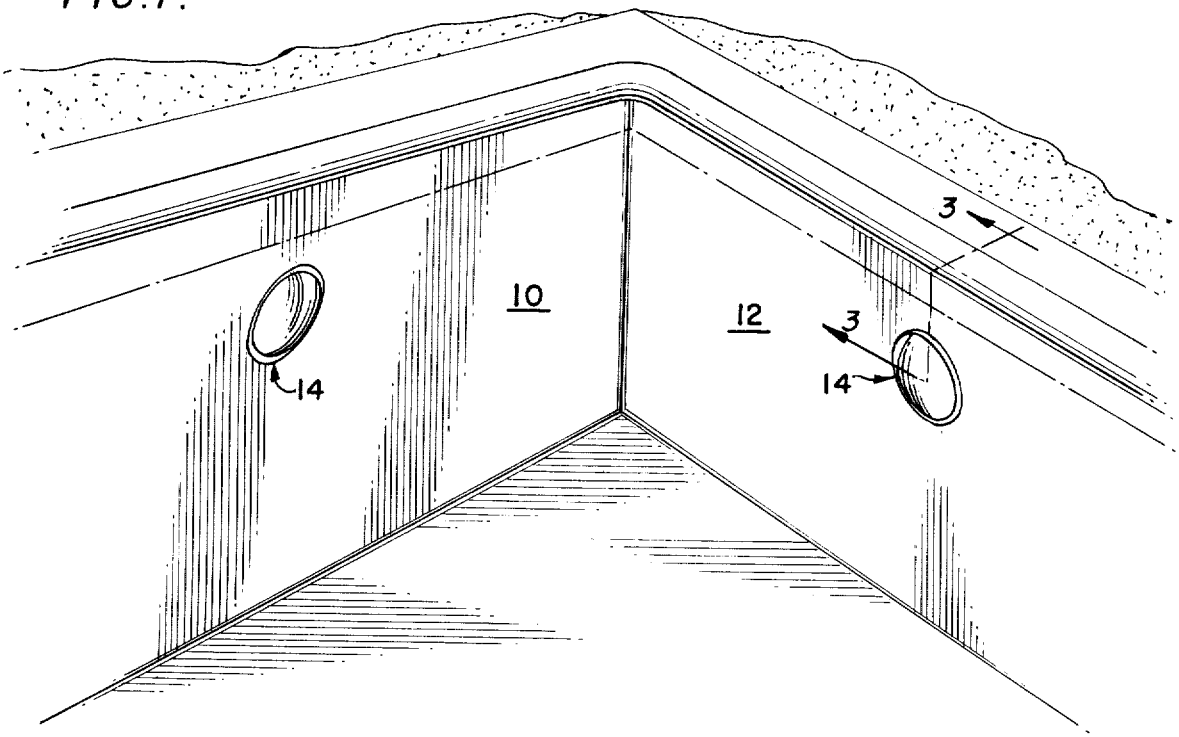
FIG. 1 is an elevational view showing a portion of a swimming pool installation including two of the floodlight assemblies of the present invention.

Referring to FIG. 1, there is depicted a swimming pool installation having two adjacent walls shown by the reference numerals 10 and 12. The walls are formed by applying plaster, or other similar material over poured concrete, as will be explained in detail later. The floodlight assembly of the present invention is shown in general by the reference numeral 14 installed in each wall 10 and 12.

Figure 2:
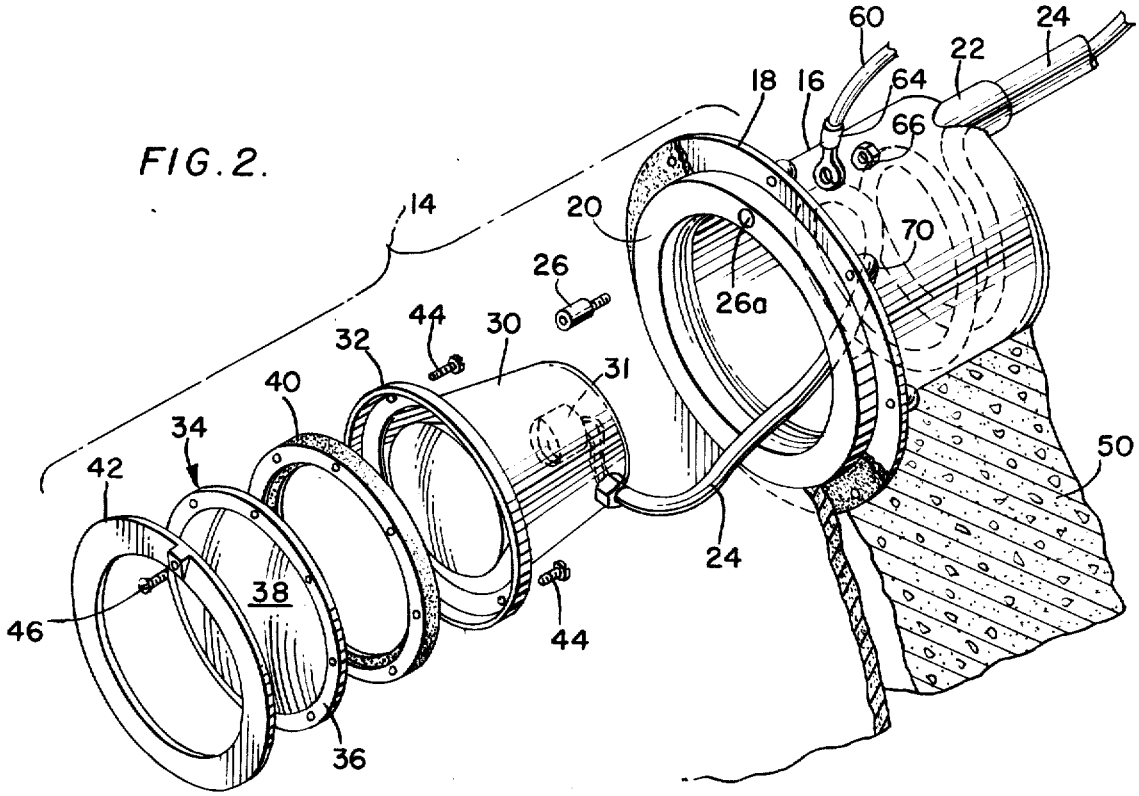
FIG. 2 is an enlarged, exploded, perspective view of a floodlight assembly of the present invention.
Figure 3:
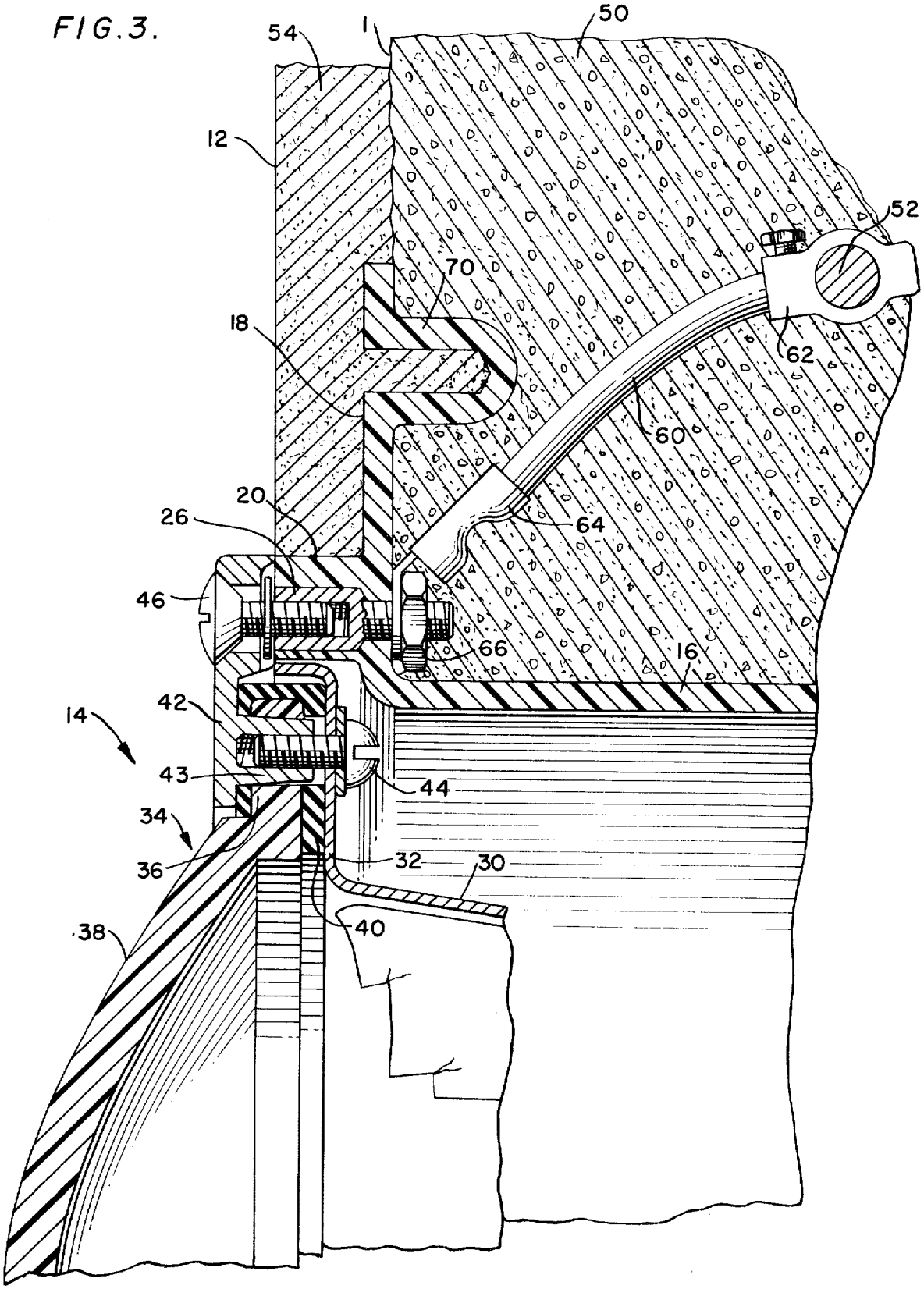
FIG. 3 is an enlarged sectional view taken along the line 3—3 of FIG. 1.

Referring to FIGS. 2 and 3, the assembly 14 includes an open-ended shell 16 having an integrally formed flange 18 projecting from its open end portion, and a circular boss 20 projecting outwardly from the flange 18. The shell 16 is preferably formed of a plastic material and includes an internally threaded hub 22 formed integral therewith which is in threaded engagement with an electrical cable conduit 24. An insert 26 of an electrically conductive material, such as brass, extends in a corresponding opening **26*a* formed in the boss portion 20 of the flange 18.**

An inner housing, shown in general by the reference numeral 30, is adapted to extend within the shell 16 and includes a light bulb receptacle 31 which is connected to the electrical conduit 24. The housing 30 has an outwardly extending flange 32 which is substantially L-shaped in cross-section.

A cover assembly 34 is adapted to cover the open ends of the shell 16 and the inner housing 30 and consists of an outer ring portion 36 and a lens portion 38 of a transparent material such as glass. A gasket 40 is adapted to extend over the ring portion 36 of the cover assembly 34, and a face ring 42 of an electrically conductive material, such as brass, extends over the gasket 40. A plurality of spaced bosses 43 are formed on the inner surface of the face ring 42 and extend through corresponding aligned openings formed in the gasket 40 and the ring 36 of the cover assembly 34. A plurality of mounting screws 44 extend through openings in the flange 32 of the inner housing 30 and threadably engage the bosses 43 to attach the cover assembly 34 to the inner housing. A retaining screw 46 extends through an opening formed in the face ring 42 and engages a threaded opening formed in the insert 26 to secure the face ring to the shell 16.

As shown in FIG. 3, the wall 12 is formed by poured concrete, referred to in general by the reference numeral 50, which includes reinforcing rods of steel or the like, with one being shown by the reference numeral 52. An outer layer of plaster 54, or other similar material, is applied to the concrete 50 to provide a finishing surface into which the assembly 14 extends.

An electrical connector 60 is connected at one end to a clamp 62 which extends over the reinforcing rod 52. The other end of the connector 60 is connected, via a connection member 64, to a stud portion of the brass insert 26, and is secured by a nut 66, to thus ground the insert with respect to the rod. A plurality of spaced bosses 70 are formed on the inner surface of the flange 18 and, in the position of FIG. 3, are embedded in the concrete 50.

To install the assembly 14, the shell 16 is initially placed in position, with the insert 26 extending within the circular boss 20. The conductor 60 is connected to the insert 26 and to the rod 52, and the concrete is poured. As a result, the inner face of the flange 18 abuts the outer surface of the concrete, and the bosses 70 are embedded in the concrete. The plaster 54 is then finished over the concrete and flush with the outer surface of the circular boss 20 to completely embed the shell 16.

A subassembly formed by the inner housing 30, the cover assembly 34, the gasket 40, and the face ring 42 can be connected together in the position shown in FIG. 3, i.e. with the gasket 40 extending over the ring 36 of the cover assembly, with the flange portion 32 of the inner housing 30 in contact with the inner face of the gasket 40, and with the face ring 42 in contact with the outer face of the gasket 40. The screws 44 are then threadedly engaged with the bosses 43 of the face ring 42 to secure the subassembly together and render the subassembly water tight. The subassembly is then connected relative to the shell 16 by inserting the retaining screw 46 through the opening formed in the face ring 42 and into the internally threaded portion of the brass insert 26. Water can pass in the annular space between the inner housing 30 and the shell 16 and thus serves as a coolant.

In the event of a short or the like occurring in the electrical system, the inner housing 30 is grounded via the screw 44, the face ring 42, the retaining screw 46, the brass insert 26, the electrical conductor 60, and the reinforcing rod 52.

Several advantages result from the foregoing arrangement. For example, the use of the shell 16 manufactured in one piece and including the integrally formed flange 18, bosses 70, and hub 22 decreases the cost and bulkiness of the assembly. Also, the provision of the flange 18 with the internally extending bosses 70 secures the shell 16 firmly relative to the wall. Further, the subassembly consisting of the cover assembly 34, the face ring 42, the gasket 40, and the inner housing 30 can be easily detached from the shell 16 by simply releasing the screw 46, to permit replacement of the bulb in the inner housing 30, or the like. Also, a superior electrical ground system is achieved in the manner mentioned above.

Figure 4:
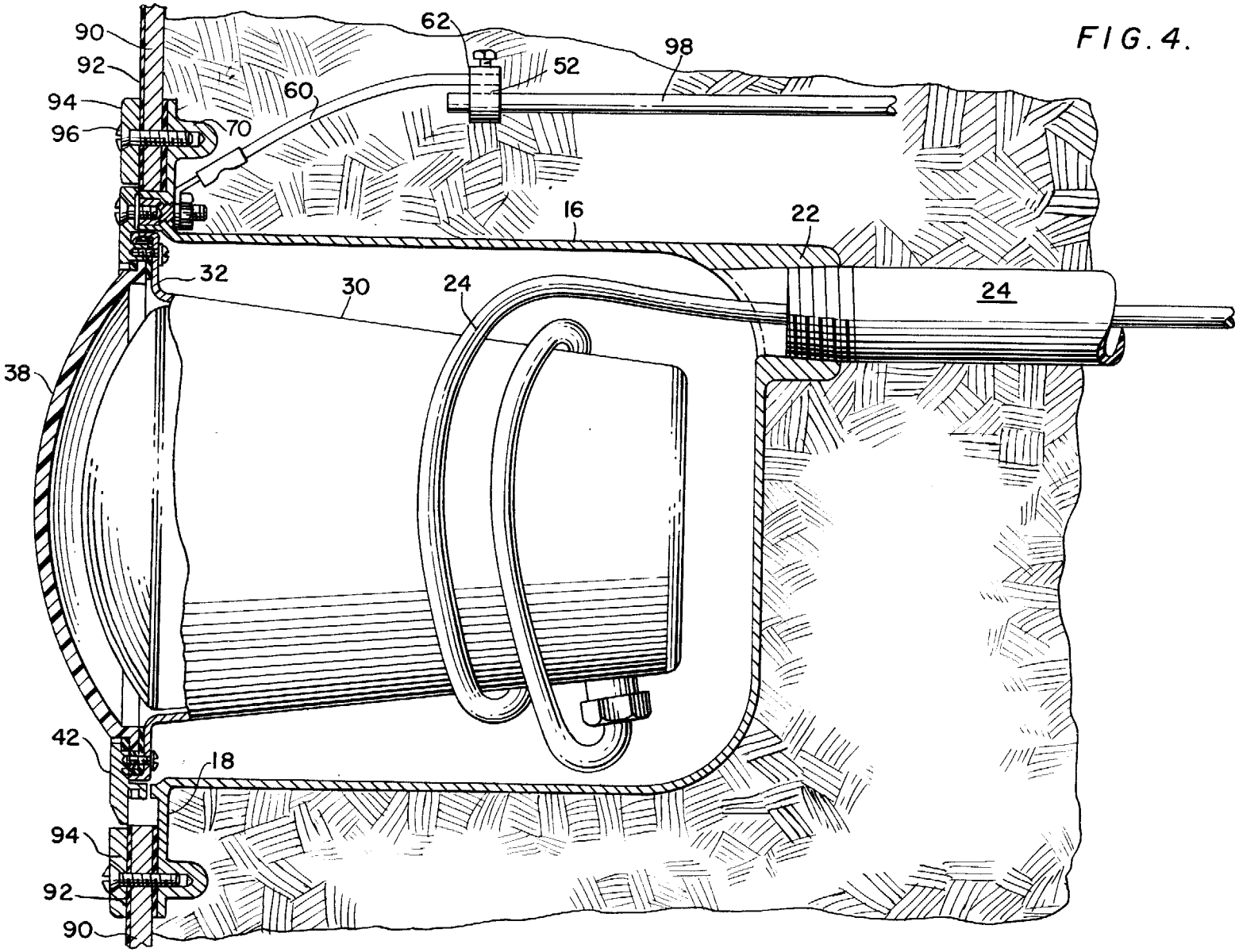
FIG. 4 is a sectional view depicting an alternate embodiment of the present invention.

According to the embodiment of FIG. 4, the outer surface of the walls forming the swimming pool are formed by a plurality of panels one of which is shown by the reference numeral 90. The panels 90 may be of plywood, aluminum, steel or fiberglass reinforced plastic and are disposed in a side-by-side juxtaposed relationship, with their inner surfaces contacting the earth. A vinyl liner 92 is disposed on the outer surface of each panel 90, and each panel is sandwiched between the outer surface of the flange 18 of the shell 16 and an adapter ring 94 which extends immediately radially outwardly from the face ring 42 in engagement with the vinyl liner 92. A plurality of screws 96 extend through the adapter ring 94, the liner 92, the panel 90, and into an internally threaded opening provided in the boss 70 on the flange 18. The remaining components are identical to those of the previous embodiment with the exception that a copper rod 98 is driven into the earth to provide an electrical ground. The embodiment of FIG. 4 thus enjoys all of the above-mentioned advantages of the previous embodiment.

It is understood that the assembly of the present invention is not limited to use with a swimming pool, but can be installed in other types of water reservoirs, such as water fountains, and the like.

Of course, other variations of the specific construction and arrangement of the assembly disclosed above can be made by those skilled in the art without departing from the invention as defined in the appended claims.

We claim:

1. An underwater floodlight assembly comprising an open-ended shell adapted to extend in an opening formed in a wall of a reservoir for water, said shell having an outwardly extending integrally formed flange which engages the surface of said wall, a plurality of bosses formed integrally with said flange, said bosses extending in a spaced relationship around said shell and extending into said wall, an open-ended inner housing disposed within said shell and including light bulb receptacle means, and cover means for covering the open ends of said housing and said shell.

2. The assembly of claim 1 wherein said bosses are internally threaded and further comprising panel means adapted to engage said wall, an adapter plate extending around said cover and in engagement with said panel means, and a plurality of fasteners extending through said adapter plate and said panel means and in threaded engagement with said bosses to secure said panel means to said wall.

3. The assembly of claim 1 further comprising an insert of an electrical conductive material molded integral with said flange and connected to ground, said mounting means establishing an electrical current flow path from said housing to said insert.

4. The assembly of claim 3 wherein said wall is formed of concrete and wherein said insert is connected to ground by an electrical conductor connecting said insert to a reinforcing rod for said concrete.

5. An underwater floodlight assembly comprising an open-ended shell adapted to extend in an opening formed in a wall of a reservoir for water, said shell being formed of plastic and having an outwardly extending integrally formed flange which engages the surface of said wall, an insert of an electrical conductive material molded integral with said flange and connected to ground, an open ended inner housing disposed with said shell and including light bulb receptacle means, cover means for covering the open ends of said housing and said shell, and means mounting said cover means to said housing and said shell, said mounting means establishing an electrical current flow path from said housing to said insert.

6. The assembly of claim 5 wherein said bosses are internally threaded and further comprising panel means adapted to engage said wall, an adapter plate extending around said cover and in engagement with said panel means, and a plurality of fasteners extending through said adapter plate and said panel means and in threaded engagement with said bosses, to secure said panel means to said wall.

7. The assembly of claim 5 wherein said wall is formed of concrete and wherein said insert is connected to ground by an electrical conductor connecting said insert to a reinforcing rod for said concrete.

8. An underwater floodlight assembly comprising an open-ended shell adapted to extend in an opening formed in a wall of a reservoir for water, said shell being formed of a plastic material and including an integrally formed hub which is internally threaded for connection to a conduit containing an electrical conductor, an insert of an electrical conductive material molded integral with said shell and connected to ground, an open-ended inner housing disposed within said shell and including light bulb receptacle means electrically connected to said conductor, cover means for covering the open ends of said housing and said shell, and mounting means mounting said cover means to said insert and said shell, said mounting means establishing an electrical current flow path from said housing to said insert.

9. The assembly of claim 8 further comprising panel means adapted to engage said wall, an adapter plate extending around said cover and in engagement with said panel means, and a plurality of fasteners extending through said adapter plate and said panel means and in threaded engagement with said shell to secure said panel means to said wall.

10. The assembly of claim 8 wherein said wall is formed of concrete and wherein said insert is connected to ground by an electrical conductor connecting said insert to a reinforcing rod for said concrete.

* * * * *